US005668096A

United States Patent [19]

Rodzewich et al.

[11] Patent Number: 5,668,096

[45] Date of Patent: Sep. 16, 1997

[54] CLEANING AND PASSIVATING TREATMENT FOR METALS

[75] Inventors: Edward A. Rodzewich, Flourtown; Barry P. Gunagan, Hatboro, both of Pa.

[73] Assignee: BetzDearborn Inc., Trevose, Pa.

[21] Appl. No.: 743,118

[22] Filed: Nov. 4, 1996

Related U.S. Application Data

[63] Continuation-in-part of Ser. No. 508,805, Jul. 28, 1995, abandoned, which is a continuation-in-part of Ser. No. 246,550, May 20, 1994, abandoned.

[51] Int. Cl.[6] ..... C11D 1/88

[52] U.S. Cl. ..... 510/265; 510/258; 510/422; 510/500; 252/385; 252/389.4; 252/389.54; 252/396

[58] Field of Search ..... 510/500, 258, 510/265, 422; 252/385, 389.4, 389.54, 396

[56] References Cited

U.S. PATENT DOCUMENTS

| | | | |
|---|---|---|---|
| 3,715,292 | 2/1973 | Wieczorek | 204/145 R |
| 4,389,371 | 6/1983 | Wilson et al. | 422/15 |
| 4,450,088 | 5/1984 | Wilson et al. | 252/75 |
| 4,578,205 | 3/1986 | Yeakey et al. | 252/76 |
| 4,578,208 | 3/1986 | Geke et al. | 252/135 |
| 4,610,222 | 9/1986 | Goddard et al. | 23/41.42 |
| 4,657,689 | 4/1987 | Durden | 252/75 |
| 4,687,590 | 8/1987 | Haack | 252/75 |
| 4,758,367 | 7/1988 | George | 252/75 |
| 4,759,864 | 7/1988 | Van Neste et al. | 252/75 |
| 4,824,605 | 4/1989 | Hildreth | 252/547 |
| 4,851,145 | 7/1989 | Van Neste et al. | 252/75 |
| 5,082,592 | 1/1992 | McDonald | 252/389.4 |
| 5,139,701 | 8/1992 | McDonald | 252/389.54 |
| 5,300,142 | 4/1994 | Cormier | 106/14.14 |
| 5,330,558 | 7/1994 | McCormick et al. | 75/715 |

FOREIGN PATENT DOCUMENTS

| | | |
|---|---|---|
| 0124851 | 11/1984 | European Pat. Off. . |
| 0229440 | 7/1987 | European Pat. Off. . |
| 0328872 | 8/1989 | European Pat. Off. . |
| 0552988 | 7/1993 | European Pat. Off. . |
| 1133385 | 11/1968 | United Kingdom . |
| 3595 | 3/1992 | WIPO . |

OTHER PUBLICATIONS

Chemical Abstracts: 99:125167; Vukasovich, Effects of Sodium Molybdate in Synthetic Metal Working Fluid, Schmierst Metallbearb., Int. Kollog., 1982 vol. 2, 66.1–66.8 *No Month Available.

*Primary Examiner*—Michael Tierney

*Attorney, Agent, or Firm*—Alexander D. Ricci; Steven D. Boyd

[57] ABSTRACT

A cleaning and passivating treatment for metals comprising an amphoteric surfactant which is a caprylic acid derivative of imidazoline compounds. The treatment is substantially free of amines, alkanolamines and phosphates. The preferred treatment includes small quantities of borate ions and molybdate ions. In addition a nonionic surfactant may be added as a foam control agent.

6 Claims, No Drawings

CLEANING AND PASSIVATING TREATMENT FOR METALS

This application is a continuation-in-part of application Ser. No. 08/508,805 filed Jul. 28, 1995 now abandoned which is a continuation-in-part of application Ser. No. 08/246,550 filed May 20, 1994, now abandoned.

FIELD OF THE INVENTION

The present invention relates to cleaning and passivating treatments for metals. More particularly, the present invention relates to cleaning and passivating treatments for metals which are essentially free of amines, alkanolamines, and phosphates. The aqueous treatments of the present invention comprise amphoteric surfactants which were found to provide an excellent passivating film on ferrous surfaces. The amphoteric surfactants of the present invention are caprylic acid derivatives of imidazoline compounds.

BACKGROUND OF THE INVENTION

"In process" cleaners are employed in the metal treatment industry to clean and passivate a metal surface. These types of aqueous cleaners are typically based on organic rust-proofing or passivating agents such as combinations of alkanolamines and fatty acids, surfactants, anti-foam agents and/or phosphonates and possibly biocides and builders. In order to passivate a metal surface to prevent rusting during process breaks and storage, appropriate additives are used. Cleaning and passivating agents which inhibit the corrosion of ferrous metal surfaces contain for example alkali nitrites, alkanolamines, soaps and benzoates.

Clean and passivate treatments are typically employed in applications which require good cleaning and temporary metal passivation during exposure to the atmosphere. Treated parts may need to remain rust-free, while exposed in the manufacturing plant for from several hours up to 30 days. In order to maintain their rust prevention ability, these cleaners are not rinsed. Current commercial cleaners typically employ alkanolamines such as monoethanolamine, diethanolamine or triethanolamine as a passivating agent for ferrous surfaces. The alkanolamine component inhibits flash rusting of ferrous iron parts during line stops or storage. Typical cleaners also will include surfactants such as glycol ether compounds and phosphonate compounds which aid in cleaning of the parts. For example, U.S. Pat. No. 4,578,208 which issued to Geke et al. discloses a cleaning and/or passivating composition and process which employs a phosphoric acid ester, an alkanolamine and a surfactant and optionally builders, non-ferrous metal inhibitors and biocides.

Currently, environmental objections are being raised concerning the use of alkanolamines, phosphates and glycol ethers as raw materials for industrial processes.

SUMMARY OF THE INVENTION

The present inventors discovered that a specific class of amphoteric surfactants provides excellent passivation of ferrous metals when substituted for alkanolamines. The use of amphoteric surfactants in accordance with the present invention obviates the need for amines, alkanolamines, phosphates and other currently environmentally undesirable materials in clean and passivate formulations. The inventors found that caprylic acid derivatives of imidazoline compounds provide efficacious passivation of ferrous metal surfaces. The treatment solution of the present invention is substantially free of amines, alkanolamines, and phosphates. By substantially free, it is meant that these materials are not intentionally added as active components of the treatment solution. The preferred treatment solution also includes small quantities of a borate ion and sodium molybdate. These compounds were found to allow reductions in the concentration of the amphoteric surfactant component without adversely affecting efficacy. In addition, a defoamer such as a nonionic surfactant may be desirable in spray applications.

DESCRIPTION OF THE PREFERRED EMBODIMENT

The present inventors discovered a clean and passivate treatment formulation for use in treating ferrous metal surfaces which is substantially free of amines, alkanolamines, and phosphates. The clean and passivate formulation of the present invention is an aqueous solution of a caprylic acid derivative of an imidazoline. The formulation preferably also includes a borate ion, sodium molybdate and a nonionic surfactant defoamer. The inventors found that aqueous solutions of caprylic acid derivatives of an imidazoline provide effective rust protection. It was further discovered that when such amphoteric surfactants were used in combination with a borate ion and sodium molybdate significantly lower concentrations of the amphoteric surfactant could be employed with good rust inhibition results. The borate ion may be provided by a borate salt or by boric acid.

An exemplary caprylic acid derivative of an imidazoline is 2-capryl-1-(ethyl β oxypropanoic acid) imidazoline (IV), A method of preparing this material is by a condensation reaction of nonanoic acid and amino ethylethanolamine to form 2 capryl-1-(ethanol) imidazoline (II) which is reacted with acrylic acid (III) to produce 2-capryl-1-(ethyl β oxypropanoic acid) imidazoline (IV).

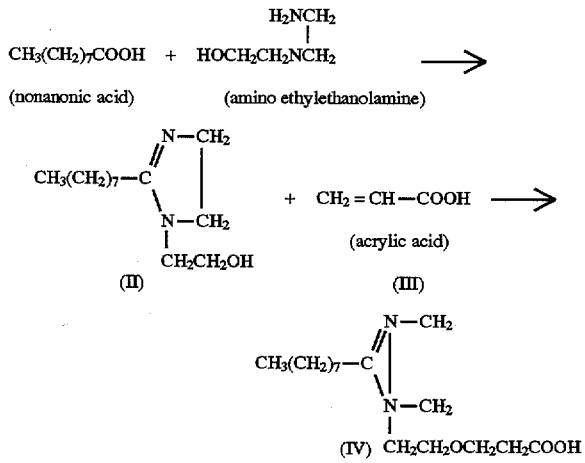

The formulation of the present invention includes amphoteric surfactants which are caprylic acid derivatives of an imidazoline compound. The surfactants are present in the treatment solution at concentrations of from about 0.05% up to about 5% by weight. Examples of commercially available amphoteric surfactants which are caprylic acid derivatives include Monateric Cy-Na 50%, a sodium salt of 2-caprylic-1 (ethyl beta oxypropanoic acid) imidazoline (Formula IV above); Monateric LF-100, a $C_{5-9}$ methyl alkyl imidazoline; Monateric LF-Na 50, a sodium salt of LF-100 but 50% active; Monateric CYA-50, a capryl amphopropionate;

Monateric 1000, a capryl amphopropionate; and Miranol JAS concentrate which is a carboxylate derivative of capryl imidazoline. Miranol is a trademark of Rhone-Poulenc and Monateric is a trademark of Mona Industries. Amphopropionate is another name for imidazoline.

When a caprylic acid derivative of an imidazoline is used alone, the preferred treatment concentration is about 5% by weight. When a caprylic acid derivative of an imidazoline is employed in the preferred combination which includes a borate ion (such as from sodium metaborate octahydrate) and a molybdate ion (such as from sodium molybdate), the concentration of the surfactant can be decreased to about 0.1 to 0.3% by weight. The preferred concentration of sodium molybdate is from about 0.1 to 0.5% by weight. The preferred concentration of sodium meta-borate octahydrate is from about 0.1 to 0.5% by weight. The ratio of imidazoline to borate ion is from about 1:0.4 to 1.5 and the ratio of molybdate ion to imidazoline and borate ion is more than about 1:4

The clean and passivate formulation of the present invention is typically supplied in two concentrate packages which are diluted and mixed prior to application. The first comprises the caprylic derivative of imidazoline compound; sodium molybdate and sodium metaborate octahydrate in deionized water. The second package comprises a nonionic surfactant defoaming agent.

Efficacy of the treatment solution of the present invention was evaluated in a chip test evaluation. The test involved placing 5 g of cast iron chips on a filter paper in a plastic weighing dish, adding 50 ml of the test solution, allowing the solution to stand for 15 minutes, mixing the iron chips and continuing immersion for 15 minutes, pouring off the solution and air drying, evaluating after 24 hours. The filter paper is rinsed with tap water and examined for rust spots. Refer to ASTM D4627-92.

The effectiveness of the composition and method of the present invention is demonstrated by the following examples which are provided as illustrative and are not intended to limit the scope of the invention as set forth in the claims.

EXAMPLE 1

A variety of amphoteric surfactants which are imidazoline compounds were tested in the above manner. Table I summarizes the results.

TABLE I

| Bath Composition | Chip Test |
|---|---|
| 99% water<br>1% Monateric 1000 | 20+ rust spots |
| 95% water<br>5% Monateric 1000 | 0 rust spots |
| 99% water<br>1% Monateric CY Na-50 | 2 rust spots |
| 95% water<br>5% Monateric CY NA-50 | 0 rust spots |
| 99% water<br>1% Monateric LF Na-50 | 5 rust spots |
| 95% water<br>5% Monateric LF Na-50 | 0 rust spots |
| 95% water<br>5% Monateric CEM-38* | 20+ rust spots |

*Monateric CEM-38 is a sodium salt of a coconut fatty acid derivative of an imidazoline compound available from Mona Industries.

The data in Table I shows that amphoteric surfactants which are caprylic acid derivatives of an imidazoline will provide chip protection while other derivatives of an imidazoline (exemplified by Monateric CEM-38, a C12–C14 fatty acid) do not provide such protection.

EXAMPLE 2

The above described chip test was employed to evaluate various treatment concentrations of the surfactant, the borate, and the molybdate. Table II summarizes the results.

TABLE II

| Clean/Passivate Bath Composition (weight %) | | | | |
|---|---|---|---|---|
| Monateric CY Na-50 | NaBO2.8H20 | Sodium Molybdate | Water | Chip Evaluation |
| 1 | — | — | 99.0 | 2 rust spots |
| 1 | 0.2 | — | 98.8 | 3 rust spots |
| 1 | 0.4 | — | 98.6 | no rust spots |
| 0.8 | 0.5 | — | 98.7 | no rust spots |
| 0.5 | 0.5 | — | 99.0 | 8 rust spots |
| 0.3 | 0.5 | — | 99.2 | 18 rust spots |
| 0.3 | 0.5 | 0.1 | 99.1 | no rust spots |
| 0.3 | 0.5 | 0.2 | 99.0 | no rust spots |
| 0.3 | — | 0.2 | 99.5 | 20+ rust spots |
| 0.2 | 0.5 | 0.1 | 99.2 | no rust spots |
| 0.1 | 0.5 | 0.1 | 99.3 | no rust spots |
| 0.1 | 0.4 | 0.1 | 99.4 | no rust spots |
| 0.1 | 0.3 | 0.1 | 99.5 | no rust spots |
| — | 0.5 | 0.1 | 99.4 | 6 rust spots |
| — | 0.5 | — | 99.5 | 20+ rust spots |
| — | — | 0.1 | 99.9 | 20+ rust spots |

The data in Table II shows that efficacious results are obtained at a relatively low treatment concentration with the preferred combination of the present invention.

EXAMPLE 3

Monateric LF-Na 50 was tested in a treatment solution including sodium metaborate octahydrate, sodium molybdate and Macol LF 110 (a nonionic polyoxyalkylated aliphatic ether available from PPG Industries, Inc. which was added as a defoamer). The addition of the borate and molybdate was found to allow excellent passivation, i.e., no chip rusting, in the above described chip test with a relatively low concentration of amphoteric surfactant. The treatment solution tested is set out in Table III in weight percent.

TABLE III

| | |
|---|---|
| Sodium meta borate octahydrate | 0.5% |
| Sodium molybdate | 0.1% |
| Monateric LF-Na-50 | 0.1% as 100% actives |
| Macol LF 110 | 0.04% |

EXAMPLE 4

The presence of Macol LF 110 in the composition of Example 3 is included to inhibit foaming tendencies of the imidazoline surfactant. The presence of the defoamer does not effect the passivating activity of the imidazoline surfactant. Table IV summarizes chip testing as described above of a treatment in accordance with the present invention with and without a nonionic polyoxyalkylated aliphatic ether defoamer (Macol LF 110 available from PPG Industries, Inc.).

TABLE IV

| Composition (grams/100 grams) | | | | | |
|---|---|---|---|---|---|
| Monateric LF Na-50 | NaBO2.8H20 | Sodium Molybdate | Water | Macol LF 110 | Chip Test |
| 1. 0.075 | 0.37 | 0.075 | 99.48 | — | no rust spots |
| 2. 0.075 | 0.37 | 0.075 | 99.44 | 0.04 | no rust spots |
| 3. 0.10 | 0.50 | 0.10 | 99.30 | — | no rust spots |
| 4. 0.10 | 0.50 | 0.10 | 99.26 | 0.04 | no rust spots |

For economies of shipping and handling, the treatment solution of the present invention is preferably supplied as a concentrate which is diluted with water to form a working bath. A preferred concentrate comprises 12.5% sodium metaborate octahydrate, 2.5% sodium molybdate, 5.0% Monateric LF-Na 50 and 80% water. The Macol LF 110 defoamer is supplied separately. A 4% v/v dilution of the preferred concentrate with 0.04% v/v of Macol LF 110 results in the treatment solution described in Example 3. This preferred treatment solution has been found to be effective when diluted with DI, soft or hard water.

Comparative Example 1

The following formulation described as Formula A in Table 2 of U.S. Pat. No. 4,758,367 was prepared.

| | |
|---|---|
| TEG (tri ethylene glycol) | 92.68 wt. % |
| Boric Acid | 1.03 wt. % |
| sodium molybdate dihydrate | 1.03 wt. % |
| potassium hydroxide | 0.03 wt. % |
| water | 5.23 wt. % |

A 4% (v/v) solution in water was prepared and evaluated as a cleaning and passivation treatment in the chip test described above. After the 24 hour test there were 20+ rust spots on the filter paper and 100% rusting of the chips.

Comparative Example 2

The following formulation described in Example 1 of U.S. Pat. No. 4,389,371 was prepared.

| | |
|---|---|
| ethylene glycol | 89.00 parts by weight |
| diethylene glycol | 5.00 parts by weight |
| water | 0.41 parts by weight |
| phosphoric acid (85%) | 1.16 parts by weight |
| triethanolamine | 4.00 parts by weight |
| tolytriazole, sodium salt(50% aqueous) | 0.20 parts by weight |
| Pluronic ® L61 | 0.03 parts by weight |
| 2heptyl-1-(ethoxypropanoic acid) imidazoline sodium salt (50%) | 0.20 parts by weight |

A 4% (v/v) solution in water was prepared and evaluated as a cleaning and passivation treatment in the chip test described above. After the 24 hour test there were 20+ rust spots on the filter paper and 100% rusting of the chips.

Comparative Example 3

Equal portions of the formulations from Comparative Examples 1 and 2 were mixed and a 4% (v/v) solution in water prepared and evaluated as a cleaning and passivating treatment in the chip test described above. After the 24 hour test there were 20+ rust spots on the filter paper and 100% rusting of the chips.

The Comparative Examples show that the corrosion inhibiting heat transfer fluids described do not provide cleaning and passivation which protects a metal surface when the metal surface is no longer in contact with the heat transfer fluid.

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. A cleaning and passivating treatment solution for ferrous metal surface comprising an essentially amine, alkanol amine and phosphate free aqueous solution of (a) from about 0.05 to 5.0% by weight a caprylic acid derivative of imidazoline amphoteric surfactant, (b) a borate ion and (c) a molybdate ion wherein the ratio of imidazoline amphoteric surfactant to borate ion is from about 1:0.4 to 1:5 and the ratio of sodium molybdate to imidazoline amphoteric surfactant and borate ion is more than about 1:4.

2. The treatment solution of claim 1 wherein said treatment solution further includes a nonionic surfactant defoaming agent.

3. The treatment solution of claim 1 wherein said borate ion is provided by sodium metaborate octahydrate.

4. The treatment solution of claim 1 wherein said molybdate ion is provided by sodium molybdate.

5. A method of cleaning and passivating a ferrous metal surface comprising contacting the ferrous metal surface with an aqueous treatment solution comprising (a) from about 0.05 to 5.0% by weight a caprylic acid derivative of imidazoline amphoteric surfactant, (b) a borate ion, and (c) a molybdate ion wherein the ratio of imidazoline amphoteric surfactant to borate ion is from about 1:0.4 to 1:5 and the ratio of sodium molybdate to imidazoline amphoteric surfactant and borate ion is more than about 1:4.

6. The method of claim 5 wherein said treatment solution further includes a nonionic surfactant defoaming agent.

* * * * *